United States Patent [19]

Irie et al.

[11] 4,208,298

[45] Jun. 17, 1980

[54] PROCESS FOR TREATING RADIOACTIVE LIQUID WASTE

[75] Inventors: Hiromitsu Irie, Higashi-Minemachi; Fumio Tajima, Tokyo; Nobuhide Kuribayashi, Tokyo; Kazuhisa Isozaki, Tokyo, all of Japan

[73] Assignees: Tokyo Shibaura Denki Kabushiki Kaisha, Kawasaki; Nippon Genshiryoku Jigyo Kabushiki Kaisha; Toshiba Engineering Kabushiki Kaisha, both of Tokyo, all of Japan; part interest to each

[21] Appl. No.: 857,449

[22] Filed: Dec. 5, 1977

Related U.S. Application Data

[62] Division of Ser. No. 689,957, May 25, 1976, abandoned.

[30] Foreign Application Priority Data

May 26, 1975 [JP] Japan ..... 50-62750

[51] Int. Cl.[2] ..... G21F 9/08

[52] U.S. Cl. ..... 252/301.1 W; 159/23; 159/47 WL; 159/DIG. 12; 165/70; 165/71; 203/4; 203/99; 203/DIG. 7

[58] Field of Search ..... 252/301.1 W; 159/23, 159/47 WL, DIG. 12; 165/70, 71; 203/4, 99, DIG. 7; 23/276, 306

[56] References Cited

U.S. PATENT DOCUMENTS 3,293,151 12/1966 Holzer et al. ..... 159/DIG. 12

3,400,753 9/1968 Slover ..... 165/70

3,714,978 2/1973 Pirk et al. ..... 165/70

*Primary Examiner*—Leland A. Sebastian

*Assistant Examiner*—Deborah L. Kyle

*Attorney, Agent, or Firm*—Stevens, Davis, Miller & Mosher

[57] ABSTRACT

In a process for treating radioactive liquid waste having an evaporation concentration device, including a concentration vessel, and a steam heater having steam inlet and outlet lines and operating to heat, with heating steam, radioactive liquid waste in the evaporation concentration device so as to concentrate the waste, contamination of the entire steam heater system in the event of leakage is prevented or greatly reduced by the provision of: (1) a sluice valve in the steam outlet line near the heater; (2) a discharge line with a drain valve for discharging any waste fluid between the heater and the sluice valve; and (3) means for receiving radioactive waste discharged through the discharge line. In accordance with the process of the present invention, when the pressure within the steam heater is less than that within the concentration vessel, and the operation of the evaporation concentration device is to be resumed, the sluice valve is first closed and the drain valve is opened. As a result, any concentrated waste solution which has infiltrated into the steam heater is discharged through the discharge line and drain valve. After a predetermined operative period of time, the drain valve is then closed and the sluice valve opened, and consequently, non-contaminated heating steam is again permitted to flow through the steam line.

3 Claims, 1 Drawing Figure

PROCESS FOR TREATING RADIOACTIVE LIQUID WASTE

This is a division of application Ser. No. 689,957 filed May 25, 1976, now abandoned.

BACKGROUND OF THE INVENTION

This invention relates generally to processes for treating radioactive liquid wastes in installations such as, for example, nuclear power stations.

One known method of treating a radioactive liquid waste produced from a nuclear power station comprises heating and vaporizing the radioactive liquid waste with heating steam so as to thereby concentrate the waste and reduce its volume.

More specifically, the features of this known method, and apparatus therefor are as follows. A radioactive liquid waste discharged from an installation such as, for example, a nuclear power station is stored in a liquid supply tank, from which it is transferred by a liquid supply pump to an evaporation concentration device. This evaporation concentration device normally comprises a concentration vessel which is generally of the vertical type. A steam heater is installed in the concentration vessel or, alternatively, in a circulation circuit path including the concentration vessel and a circulation pump. This steam heater operates to heat the above mentioned radioactive liquid waste thus supplied to the evaporation concentration device, whereby the liquid waste is evaporated and concentrated to a specific concentration.

The vapor generated by the above described heating process is conducted to a condenser where the same is cooled and rendered into a condensate. On the other hand, the waste solution concentrated as described above is discharged into a storage tank for concentrated waste solution after the operation of the above mentioned evaporation concentration device and liquid supply pump has been terminated.

In the above described process, however, there is the possibility of the heating tube of the steam heater becoming corroded and being damaged or broken depending on the properties of the radioactive liquid waste being treated. If this damage should occur, since the pressure of the heating steam is higher than the internal pressure of the evaporation concentration device when this device is operating, there is little possibility of the heating steam line being contaminated. However, when the operation of the evaporation concentration device is terminated, the heating steam condenses within the steam heater and is replaced by the concentrated waste solution within the evaporation concentration device, whereby, when the operation of the evaporation concentration device is restarted, this concentrated waste solution is introduced into the heating steam line and gives rise to operational difficulties such as, for example, radioactive contamination of the entire heating steam line.

SUMMARY OF THE INVENTION

In view of the above described difficulty, it is an object of this invention to provide a radioactive liquid waste treatment process in which radioactive contamination of the heating steam line in the evaporation concentration device can be prevented or reduced.

It is another object of the invention to provide a radioactive liquid waste treatment process in which the above stated object is achieved with a relatively simple innovation.

According to this invention, briefly summarized, there is provided a process for treating radioactive liquid waste of a system having an evaporation concentration device comprising a concentration vessel for containing radioactive liquid waste supplied thereinto, and a steam heater having steam inlet and outlet lines and operating to heat the radioactive liquid waste with heating steam so as to concentrate the same by evaporation. A sluice valve is installed in the steam outlet line for stopping fluid flow therethrough, a discharge line, for discharging radioactive waste which may have infiltrated into the heating steam tube path of the steam heater so as not to contaminate the steam in the steam outlet line, has at an intermediate part thereof, a drain valve disposed therein, and is connected at one end thereof to the steam heater, and means is provided for receiving radioactive waste solution discharged from the other end of the discharge line. In accordance with the process of the present invention, when the pressure within the steam heater is less than that within the concentration vessel, and the operation of the evaporation concentration device is to be resumed, the sluice valve is first closed and the drain valve is subsequently opened. As a result, any concentrated waste solution which has infiltrated into the steam heater is discharged through the discharge line and drain valve. After a predetermined operative period of time, the drain valve is then closed and the sluice valve opened, and consequently, non-contaminated heating steam is again permitted to flow through the steam line.

The nature, principle, utility, and further features of this invention will be more clearly apparent from the following detailed description when read in conjunction with the accompanying drawings, in which like parts are designated by like reference numerals.

DETAILED DESCRIPTION

Figure 1:
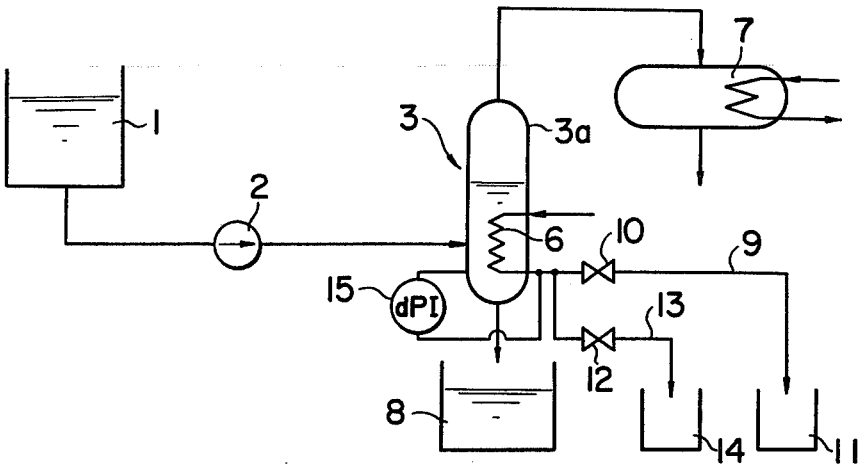
FIG. 1 is a flow diagram showing schematically the essential organization of one example of an apparatus for treating radioactive liquid waste according to the process of the present invention.
Figure 2:
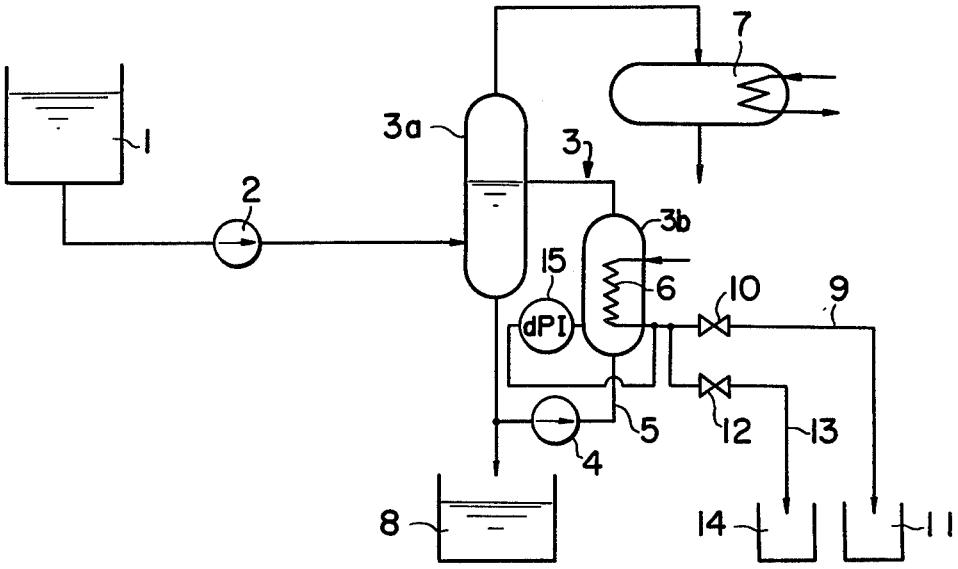
FIG. 2 is a similar diagram showing the essential organization of another example of apparatus for performing the process of the present invention.

Referring to FIGS. 1 and 2, a part of each of the apparatuses shown therein is conventional. That is, each apparatus has a liquid supply tank 1 for storing radioactive liquid waste discharged from an installation, such as, for example, a nuclear power station, an evaporation concentration device generally indicated by the reference character 3, and a liquid supply pump 2 for supplying the radioactive liquid waste from the tank 1 to the device 3.

The evaporation concentration device 3 comprises a concentration vessel 3*a* in which a steam heater 6 is installed in the apparatus illustrated in FIG. 1. Alternatively, as in the apparatus shown in FIG. 2, the steam heater 6 is installed in a heating vessel 3*b* which is disposed in a circulation circuit path including the concentration vessel 3*a*, circulation piping 5, and a circulation pump 4. As a result of the heat supplied by this steam heater 6, the radioactive liquid waste delivered to the evaporation concentration device 3 is concentrated by evaporation to a specific concentration.

The vapor generated by this heating and evaporation process is conducted from the concentration vessel 3*a* to a condenser 7 where the vapor is cooled and rendered into a condensate. On the other hand, the waste solution which has been concentrated in the above described manner is discharged from the bottom of the concentration vessel 3*a* into a storage tank 8 for storing concentrated waste solution after the operation of the evaporation concentration device 3 and the liquid supply pump 2 has been terminated.

In accordance with this invention, in the apparatus illustrated in FIG. 1, wherein the steam heater 6 is installed within the concentration vessel 3*a* of the evaporation concentration device 3, a sluice value 10 is provided in an outlet line 9 connected to the outlet of the steam heater 6. The part of the disposed outlet line 9 downstream from the sluice valve 10 conducts exhaust steam to a flushing tank 11.

Furthermore, the upstream end of a discharge line 13 for radioactive waste solution has a drain valve 12 disposed therein and is connected to the heating steam outlet line 9 at a point thereof between the steam heater 6 and the sluice valve 10. Th downstream end of the discharge line 13 discharges radioactive waste solution into a radioactive waste solution receiving tank 14. In addition, a differential pressure gauge 15, for measuring the difference between the pressures on the concentrated waste solution side and the heating steam side of the steam heater 6, is connected between the lower part of the concentration vessel 3*a* and the heating steam outlet line 9 at a part thereof upstream from the junction thereof with the discharge line 13.

In the other example of the apparatus of this invention as illustrated in FIG. 2, a sluice valve 10 is also provided in the heating steam outlet line 9 leading to a flushing tank 11, and a discharge line 13 for radioactive waste solution similarly has a drain valve 12 therein and is connected to the outlet line 9 at a point thereof between the steam heater 6 and the sluice valve 10. In addition, a differential pressure gauge 15 is connected between the heating vessel 3*b* and the steam outlet line 9 at a part thereof upstream from the sluice valve 10.

In accordance then with the process of the present invention, in the case where the differential pressure guage 15 indicates that the pressure on the heating steam side is lower than that on the concentrated waste solution side, and the evaporation concentration device 3 is to be restarted, the sluice valve 10 is first closed and the drain valve 12 is opened. As a consequence, any concentrated waste solution which has infiltrated into the steam heater 6, as described hereinbefore, and is stagnantly remaining therein, is discharged through the radioactive waste solution discharge line 13 into the radioactive waste solution receiving tank 14.

Subsequently, after the concentrated waste solution within the steam heater 6 has been completely discharged, in accordance with the above described discharging process and through the radioactive waste solution discharge line 13, for a specific operative period of time, the sluice valve 10 is opened, and the drain valve 12 is closed so as to thereby cause the heating steam to flow through the heating steam line.

While in each of the above described examples the radioactive waste solution discharge line 13 is connected to the heating steam outlet line 9, the waste solution discharge line may be connected to any part within the steam heater such that the solution within the steam heating tube can be completely discharged.

According to the process of this invention, as described above, a radioactive waste solution discharge line is connected to the heating steam tube path of the steam heater. For this reason, even in the case where the concentrated waste solution has infiltrated into the heating steam tube path of the steam heater, the introduction of the concentrated waste solution into the heating steam line, at the time of restarting of the evaporation concentration device, and the radioactive contamination of the entire heating steam line, can be positively prevented. Moreover, it is not necessary to provide an intermediate heat exchanger for preventing this radioactive contamination.

We claim:

1. A method of preventing radioactive contamination of the outlet line of a steam heater provided within an evaporation concentration device for heating and concentrating radioactive liquid waste supplied into said device, said method comprising the steps of:

detecting, when the evaporation concentration device is to be restarted, a differential pressure condition, between the interior of said steam heater and said radioactive liquid waste within said device, under inoperative conditions of said device;

closing a sluice valve disposed within said steam outlet line when the pressure within said steam heater is less than that of said radioactive liquid waste within said device so as to prevent any radioactive liquid waste, which may have infiltrated into said steam heater from said device, from flowing through said outlet line into the downstream end of the steam heating system;

opening a drain valve disposed within a discharge line connected to said steam heater so as to permit contaminated steam condensate within said steam heater to be completely discharged into said discharge line;

closing the drain valve after a predetermined period of time sufficient to permit the radioactive liquid waste in the steam heater to be completely drained from the steam heater;

opening said sluice valve; and causing heating steam to flow through said steam heater and outlet line to restart the operation of the evaporation concentration device.

2. The method as set forth in claim 1, wherein:

said contaminated steam condensate discharged into said discharge line is further conducted into a radioactive waste solution receiving tank.

3. The method as set forth in claim 1, wherein:

said discharge of said contaminated steam condensate into said discharge line is facilitated by connecting said discharge line with said steam outlet line at a junction upstream of said sluice valve.

* * * * *